US011251513B2

(12) United States Patent
Rogers

(10) Patent No.: US 11,251,513 B2
(45) Date of Patent: Feb. 15, 2022

(54) WAVEGUIDE TO LAMINATED CIRCUIT BOARD TRANSITION COMPRISING A LATERAL COUPLING THROUGH A SIDEWALL OF THE WAVEGUIDE

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 26 days.

(21) Appl. No.: 16/560,767

(22) Filed: Sep. 4, 2019

(65) Prior Publication Data

US 2021/0066777 A1 Mar. 4, 2021

(51) Int. Cl.
*H01P 5/107* (2006.01)
*H01P 11/00* (2006.01)

(52) U.S. Cl.
CPC ..... *H01P 5/107* (2013.01); *H01P 11/006* (2013.01); *H01P 11/007* (2013.01)

(58) Field of Classification Search
CPC ..... H01P 5/107
USPC ..... 333/26
See application file for complete search history.

(56) References Cited

U.S. PATENT DOCUMENTS 7,680,464 B2 * 3/2010 Pleva et al. ..... H01P 5/107 455/81
7,911,292 B2 * 3/2011 Byun et al. ..... H01P 5/107 333/26
9,692,100 B2 * 6/2017 Baba et al. ..... H01P 3/085

OTHER PUBLICATIONS

Ponchak, G.E., et al., "A New Rectangular Waveguide to Coplanar Waveguide Transition", NASA Technical Memorandum 102477, 1990 IEEE MTT-S International Microwave Symposium, Dallas, Texas, May 8-10, 1990, pp. 1-4.
Grabherr, W., et al., "Microstrip to Waveguide Transition Compatible With MM-Wave Integrated Circuits", IEEE Transactions on Microwave Theory and Techniques, Sep. 1994, pp. 1842-1843, vol. 42, No. 9.
Simon, W., et al., "A Novel Coplanar Transmission Line to Rectangular Waveguide Transition", 1998 IEEE MTT-S Digest, pp. 257-260.
Kaneda, N., et al., "A Broadband Microstrip-to-Waveguide Transition Using Quasi-Yagi Antenna", IEEE Transactions on Microwave Theory and Techniques, Dec. 1999, pp. 1-4, vol. 47, Issue 12.
Lin, T-H., et al., "CPW to Waveguide Transition with Tapered Slotline Probe", IEEE Microwave and Wireless Components Letters, Jul. 2001, pp. 314-316, vol. 11, No. 7.
Iizuka, H., et al., "Millimeter-wave microstrip line to waveguide transition fabricated on a single layer dielectric substrate," IEICE Transactions on Communications, Jun. 2002, pp. 13-18, vol. 37, No. 2.

* cited by examiner

*Primary Examiner* — Benny T Lee
(74) *Attorney, Agent, or Firm* — Gates & Cooper LLP

(57) ABSTRACT

A feed line to waveguide lateral transition is described consisting of: a proximity coupled antenna element on the top surface of a composite RF board, an embedded microstrip or stripline feed line, a ground plane on the bottom surface of the RF board, and a waveguide with an aperture enclosing the antenna element with a signal propagation through the waveguide being perpendicular to the antenna element.

20 Claims, 12 Drawing Sheets

WAVEGUIDE TO LAMINATED CIRCUIT BOARD TRANSITION COMPRISING A LATERAL COUPLING THROUGH A SIDEWALL OF THE WAVEGUIDE

BACKGROUND

1. Field

The present disclosure relates to systems for transmitting radio frequency signals and in particular to a circuit board having a feed to waveguide lateral transition and methods for producing same.

2. Description of the Related Art

Waveguides are used in many RF applications for low-loss signal propagation. However, waveguides are generally not compatible with RF electronics, which are more commonly integrated on printed circuit boards (PCB) as packaged electronics.

Waveguide-to-coax adapters are commonly used for transitioning from a waveguide to a coax such that a transition can be made to a planar trace, such as microstrip, for interfacing with PCB-based RF electronics. Existing waveguide-to-coax transitions using commercially available adapters often require two adapters: one for a waveguide-to-coax transition and another for coax-to-microstrip transition on a PCB board. Such adapters can be cost prohibitive at higher frequencies as such adapters are small requiring high precision machining. Also, the size and weight of existing waveguide-to-coax transitions make them non-ideal for many applications, and multiple transitions would increase costs and have higher size, weight, and power (SWaP) constraints.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

To address at least one or more of the requirements described above, this document discloses a circuit board having a feed to waveguide transition. In one embodiment, the circuit board comprises a laminate and a waveguide. The laminate comprises a conductive antenna element disposed on a top surface of a first dielectric layer, a second dielectric layer having a top surface disposed below and adjacent a bottom surface of the first dielectric layer, a conductor, disposed on a top surface of a third dielectric layer, the third dielectric layer having a top surface disposed below and adjacent to a bottom surface of the second dielectric layer, and a conductive ground plane disposed on a bottom surface of a fourth dielectric layer, the fourth dielectric layer having a top surface disposed below and adjacent to a bottom surface of the third dielectric layer. The waveguide comprises a closed end electrically terminating the waveguide, an aperture formed within the waveguide and perpendicular to the closed end, and wherein the waveguide is attached to the top surface of the first dielectric layer with the aperture peripherally surrounding and electrically isolated from the conductive antenna element.

Another embodiment is evidenced by a method of producing a circuit board having a feed to waveguide transition.

The method comprises disposing a conductive antenna element on a top surface of a first dielectric layer, disposing a conductor on a top surface of a third dielectric layer, dispose a conductive ground plane on a bottom surface of a fourth dielectric layer, preparing a laminate having the first dielectric layer disposed over a second dielectric layer, the second dielectric layer disposed over the third dielectric layer, and the third dielectric disposed over a fourth dielectric layer, wherein the conductor forms a feed with the conductive ground plane and terminates proximate a center of the conductive antenna element, and attaching a waveguide, having a closed end electrically terminating the waveguide, to a top surface of the first dielectric layer. The waveguide has an aperture formed within the waveguide and perpendicular to the closed end, the aperture peripherally surrounding and electrically isolated from the conductive antenna element. Another embodiment is evidenced by a circuit board produced using the foregoing operations.

The features, functions, and advantages that have been discussed can be achieved independently in various embodiments of the present invention or may be combined in yet other embodiments, further details of which can be seen with reference to the following description and drawings.

BRIEF DESCRIPTION OF THE DRAWINGS

Referring now to the drawings in which like reference numbers represent corresponding parts throughout the specification description of the drawings and may not be described in every drawing figure:

FIG. 12 is a diagram depicting the location of a cross section (A-A') of the RF circuit board having the stripline to waveguide transition.

DESCRIPTION

In the following description, reference is made to the accompanying drawings which form a part hereof, and which is shown, by way of illustration, several embodiments. It is understood that other embodiments may be utilized and structural changes may be made without departing from the scope of the present disclosure.

Overview

Figure 1:
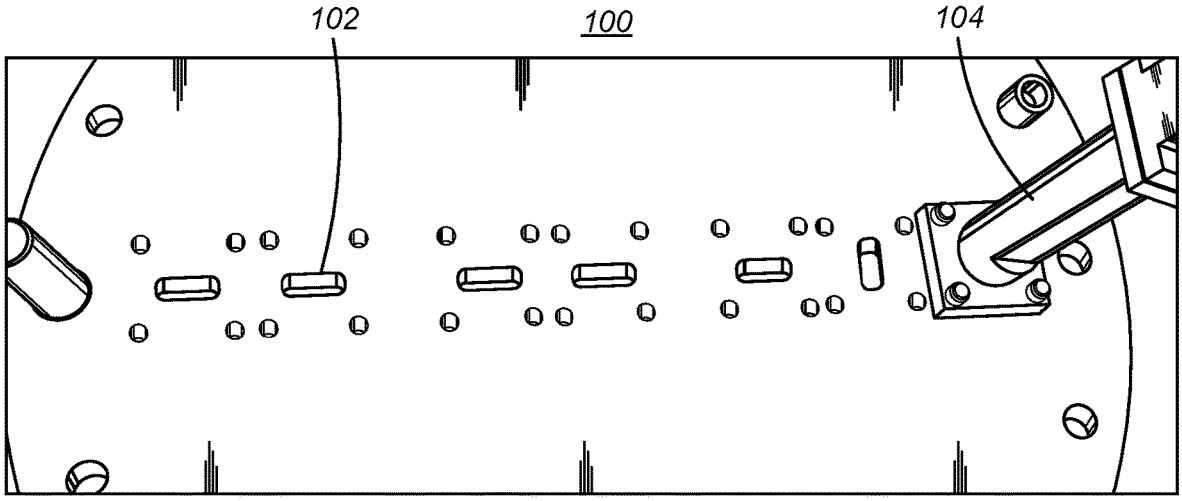
FIG. 1 Prior Art
FIG. 1 is a diagram illustrating a low power steerable array.

FIG. 1 is a diagram illustrating a low power steerable array (LPSA) 100. The LPSA offers a low cost, low power solution for antenna steering. The LPSA 100 is fed by an array of waveguides 104, each waveguide feeding a respective aperture 102 in a conductive plate. This LPSA 100 would require waveguide-to-coax and coax-to-microstrip transitions for each waveguide 104, increasing weight and cost and making manufacturing more difficult.

In this disclosure, a composite RF circuit board having a feed to waveguide lateral transition and a method for producing the circuit board is described. This provides a low-loss microstrip to waveguide transition that has low SWaP constraints, and can be used for example, in applications such as is illustrated in FIG. 1.

The composite RF circuit board has an antenna element that is proximity coupled to a waveguide feed, and a waveguide attached to the surface of the composite RF circuit board that encloses the antenna element. In one embodiment, the waveguide feed comprises microstrip formed by a conductor electrically coupled to a ground plane on a side of the RF circuit board opposing the waveguide. In another embodiment, the waveguide feed comprises a stripline electrically coupled between two parallel and electrically connected ground planes. The ground plane(s) minimize changes in electrical behavior due to environmental surfaces, and thus permits mounting the composite RF circuit board on or immediately adjacent to conductive surfaces such as external surfaces of an airplane or other vehicle.

The composite RF circuit board provides a lateral transition that is of reduced weight, size, cost, and complexity when compared to existing waveguide-to-coax adapters. For example, referring again to FIG. 1, the lateral transition from the RF circuit board to the waveguide permits the RF electronics to reside in a single RF board for ease of production and efficient signal propagation and processing.

The composite RF circuit board can be adapted to any antenna or waveguide geometric shape (e.g. those with rectangular, circular, or other cross sections) for efficient signal propagation, and can be manufactured using a combination of subtractive (e.g. laser etch, milling, or wet etching) and additive (e.g. printing or film deposition) processes.

Microstrip to Waveguide Lateral Transition

Figure 2A:
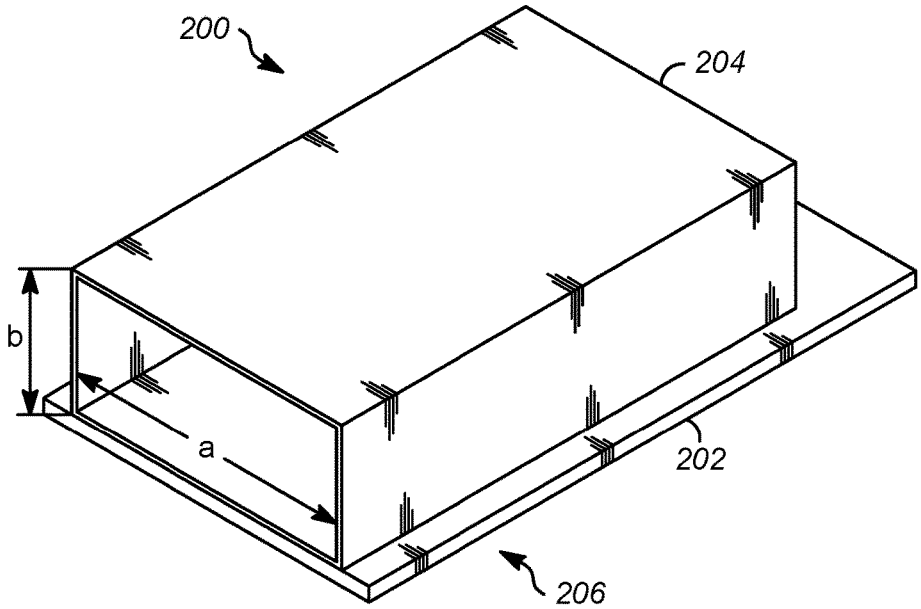
FIGS. 2A and 2B are diagrams illustrating an exemplary embodiment of an RF circuit board having a microstrip to waveguide lateral transition.
Figure 2B:
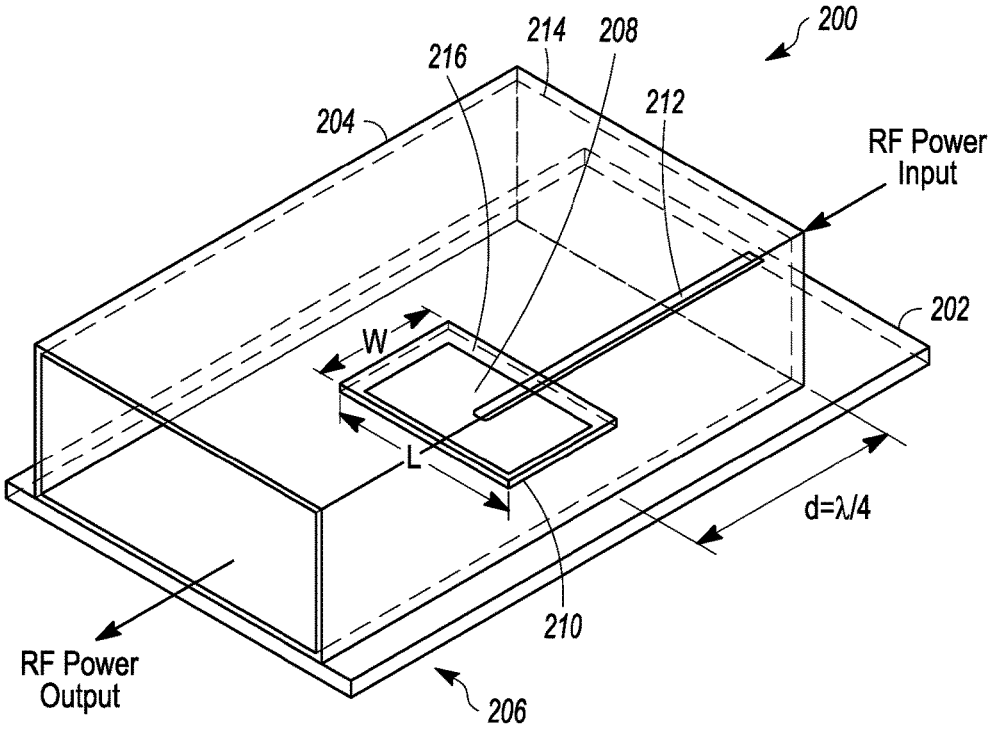

FIGS. 2A and 2B are diagrams illustrating an exemplary embodiment of an RF circuit board 200 having a microstrip to waveguide lateral transition of the waveguide 204, with the transition occurring proximate a closed end 214 disposed at the rear of the waveguide 204. The transition consists of: a proximity coupled conductive antenna element 208, an embedded planar circuit board conductor 212 forming a microstrip feed line, a bottom surface ground plane 206 on a bottom surface of a laminate 202, and a waveguide 204 enclosing the conductive antenna element 208. The dimensions of the conductive antenna element 208 (i.e., length L, and width W in FIG. 2B) and gap 216 between the conductive antenna element 208 and an aperture 210 in the waveguide 204 are numerically determined to maximize signal propagation at the desired operating frequency. The proximity coupled conductive antenna element 208, the embedded microstrip feed line 212 and the bottom surface ground plane 206 are on different metallic layers of a composite laminate 202.

As illustrated, the RF circuit board 200 comprises a laminate 202 and a waveguide 204 mounted thereon. The laminate 202 comprises a conductive antenna element 208 disposed on a top surface of the laminate 202 and a bottom surface conductive ground plane 206 disposed on a bottom surface of the laminate 202. The waveguide 204 has a closed end 214 electrically terminating the waveguide 204, and an aperture 210 formed in a waveguide surface perpendicular to the closed end 214 and adjacent the laminate 202. The aperture 210 peripherally surrounds the conductive antenna element 208 and is electrically isolated from the conductive antenna element 208 by virtue of a gap 216 disposed therebetween throughout the periphery.

The conductive antenna element 208 is fed by a microstrip formed by a conductor 212 disposed in the laminate and the bottom surface conductive ground plane 206. The microstrip proximity couples the conductor 212 and the antenna element 208. In one embodiment, the conductive antenna element 208 comprises a patch antenna element.

In the illustrated embodiment, the distance d between the closed end of the waveguide 204 and the physical and electrical center of the conductive antenna element 208 is selected to be ¼ of the wavelength ($\lambda/4$) of the center frequency of the signal transmitted by the waveguide 204. This value reduces the transition loss at the operating frequencies of interest.

In the embodiment illustrated in FIGS. 2A and 2B, the waveguide 204 propagates electromagnetic energy in a direction along a waveguide 204 longitudinal axis, as indicated by the RF Power Output arrow of FIG. 2B, and the conductor 212 is lengthwise disposed along a conductor longitudinal axis indicated by the RF Power input arrow of FIG. 2B that is parallel to the waveguide longitudinal axis. Importantly, this has packaging advantages, as the waveguide 204 can be placed directly on the laminate 202, with the waveguide longitudinal axis (and the RF power output) parallel to the plane of the laminate 202.

Also in the embodiment illustrated in FIGS. 2A and 2B, the waveguide has a rectangular cross section having an interior height and an interior width (respectively depicted as "b" and "a" in FIG. 2A). In the illustrated embodiment, the interior width "a" is greater than the interior height "b" and the waveguide outer surface of the greater dimension (here, the width) is mounted to the laminate 202.

The conductive antenna element 208 has a surface area shape and size dictated by the shape and size of the interior of the waveguide 204. In the illustrated embodiment, the conductive antenna element 208 is rectangular to electrically couple with the interior volume of the waveguide, and has a width "W" and length "L" greater than the width, with the longer of the two dimensions matching the longer of the waveguide 204 interior dimensions.

The cutoff frequency of the waveguide is a function of the width "a" of the waveguide, the height "b" of the waveguide, and the permittivity of the material in the waveguide according to the following relationship:

$$f_o = \frac{c}{2\sqrt{\varepsilon_{rs}}}\sqrt{\left(\frac{1}{a}\right)^2 + \left(\frac{1}{b}\right)^2}$$

where $f_o$ is the cutoff frequency of the waveguide, a is the width of the waveguide, b is the height of the waveguide and $\varepsilon_{rs}$ is the permittivity of the material in the waveguide (typically air, which has a permittivity of one).

The conductive antenna element 208 has a surface area shape and size dictated by the shape and size of the interior of the waveguide 204. In the illustrated embodiment, the conductive antenna element 208 is rectangular to electrically couple with the interior volume of the waveguide, and has a width "W" and length "L" greater than the width, with the longer of the two dimensions matching the longer of the waveguide 204 interior dimensions.

For example, the dimensions of the conductive antenna element 208 can be selected according to:

$$L = \frac{\lambda}{2}$$

where λ is the wavelength of the desired operating signal.

Figure 3A:
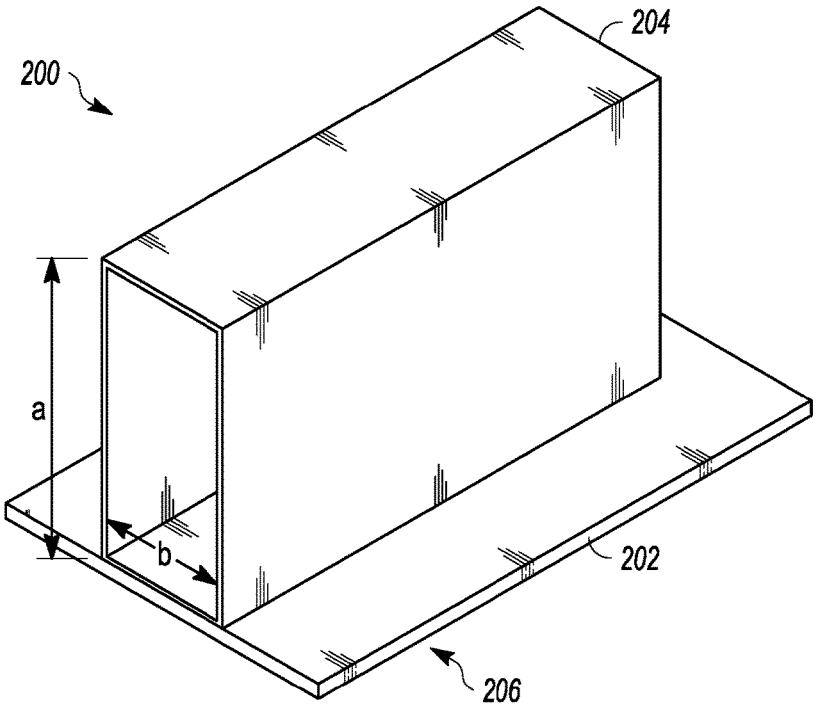
FIGS. 3A and 3B are diagrams illustrating another exemplary embodiment of the RF circuit board.
Figure 3B:
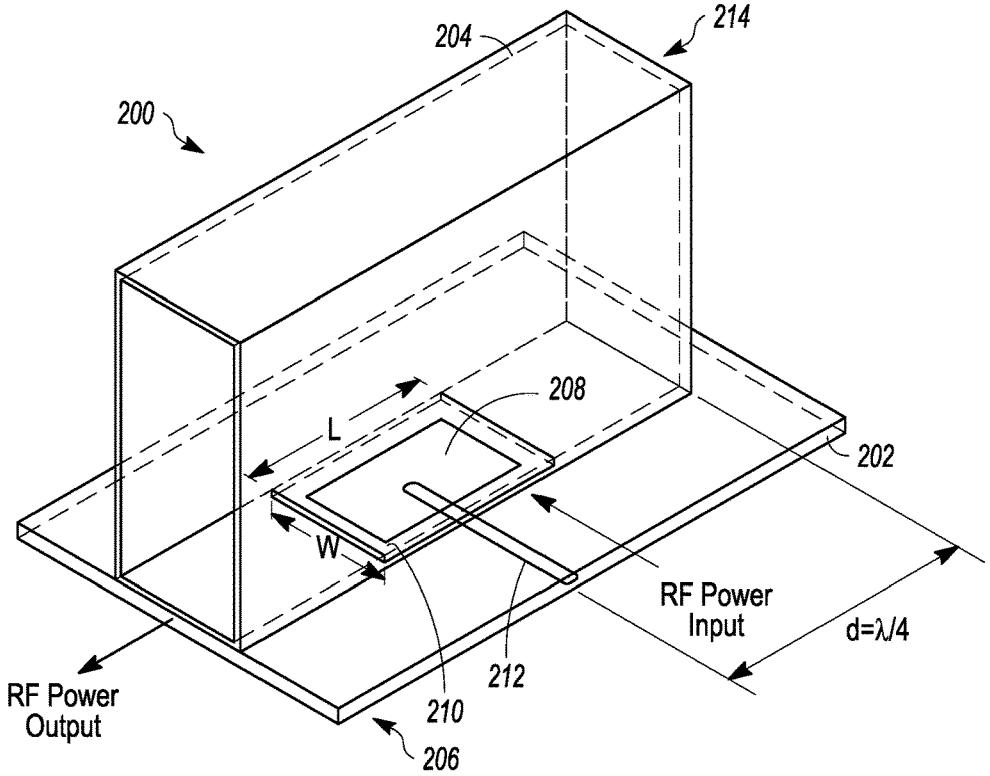

FIGS. 3A and 3B are diagrams illustrating another embodiment of the RF circuit board 200. This embodiment differs from the embodiment illustrated in FIGS. 2A and 2B in several respects. First, the waveguide 204 of the embodiment illustrated in FIGS. 3A and 3B is mounted with the lesser dimension (here, the width "a") mounted to the laminate 202. Second, the conductor 212 forming the microstrip is now along a longitudinal axis (also labeled RF Power Input as depicted in FIG. 3B) perpendicular to the waveguide longitudinal axis. Third, the conductive antenna element 208 and aperture 210 have been reoriented so that the larger dimension ("L") of the conductive antenna element 208 extends lengthwise along the waveguide longitudinal access. Also in this embodiment, the narrow dimension ("W") of the aperture 210 is co-extensive with the interior width ("a") of the waveguide 204.

Although FIGS. 2A, 2B, 3A, and 3B depict the use of waveguides 204 as rectangular, waveguides of other cross sections (e.g. circular) may also be utilized. In such cases, the laminate 202 may comprise a matching surface.

Exemplary Performance

Figure 4:
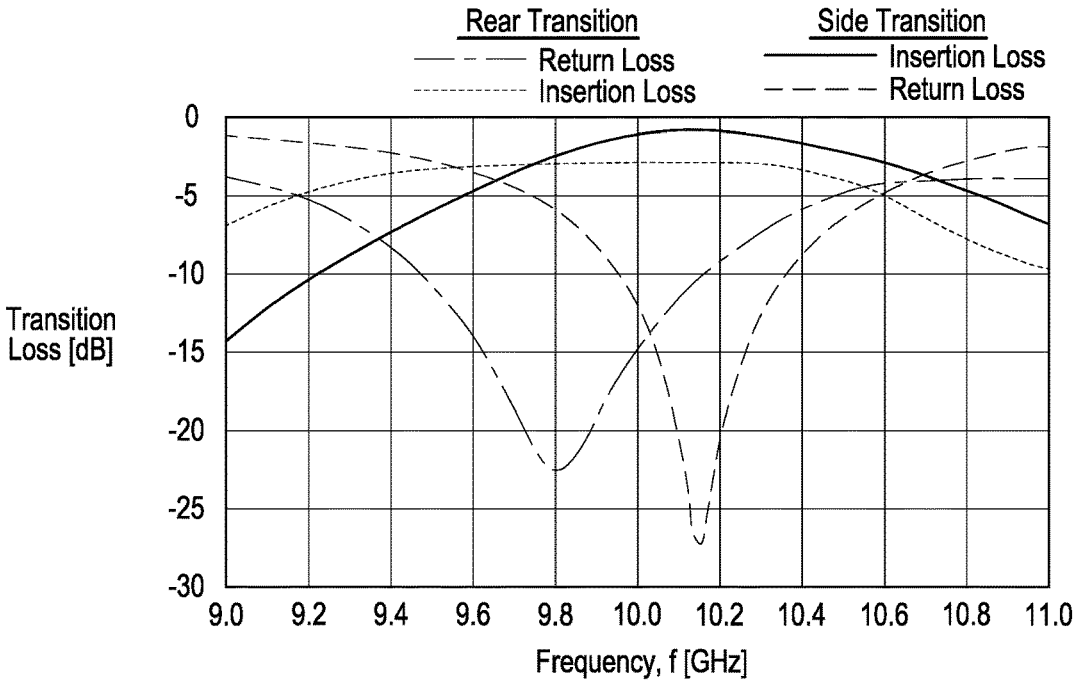
FIG. 4 is a diagram depicting the results of a numerical model simulation predicting the performance of the microstrip to waveguide lateral transitions depicted in FIGS. 2A-2B and 3A-3B.

FIG. 4 is a diagram depicting the results of a numerical model simulation predicting the performance of the microstrip to waveguide lateral transitions depicted in FIGS. 2A-2B and 3A-3B designed to operate near 10 GHz. The results show the transition loss in dB (including both insertion and return loss) vs. frequency in GHz for a rear transition embodiment illustrated in FIGS. 2A and 2B and a side transition embodiment illustrated in FIGS. 3A and 3B. These results were developed using a finite element method (FEM) solver.

The rear feed embodiment illustrated in FIGS. 2A and 2B has a conductor 212 forming a microstrip feed electrically coupled to the waveguide 204 from the rear of the waveguide with the closed end 214. The model predicts an insertion loss of ~2.8 dB, a 3 dB bandwidth of ~1580 MHz, and a 2:1 voltage standing wave ratio (VSWR) impedance bandwidth of ~720 MHz The side feed embodiment illustrated in FIGS. 3A and 3B has a conductor 212 forming a microstrip electrically coupled to a waveguide from the side of the waveguide. The model predicts an insertion loss of ~0.8 dB, a 3 dB bandwidth of ~1020 MHz, and a 2:1 VSWR impedance bandwidth of ~430 MHz.

Of course, the exemplary performance depicted in FIG. 4 represents predicted performance for a transition designed to operate near 10 GHz. The microstrip to waveguide lateral transitions depicted in FIGS. 2A-2B and 3A-3B may be designed to operate at other frequencies, with similar transition loss performance.

Current Density

Figure 5:
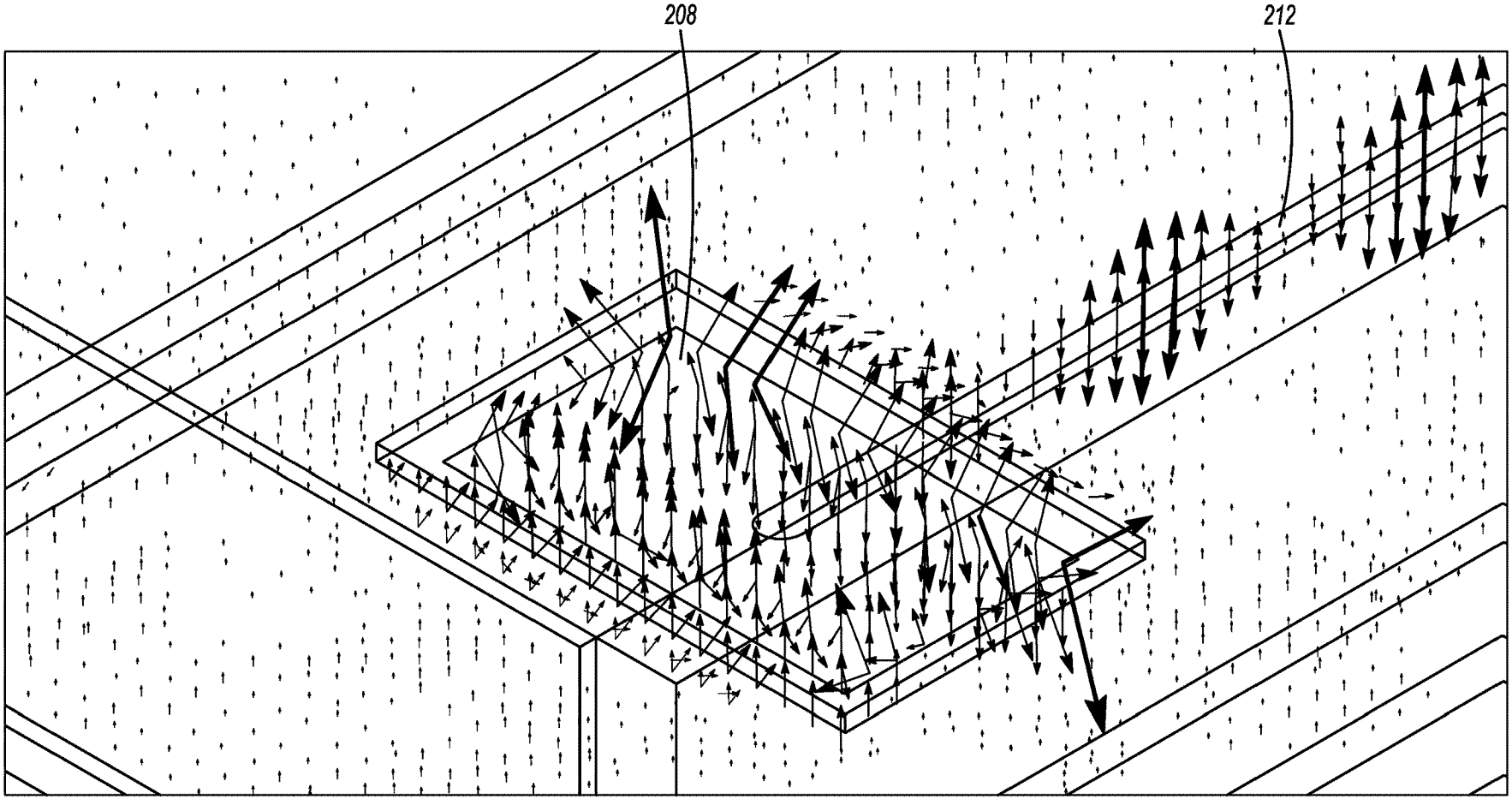
FIG. 5 depicts a field plot showing the electric field (in V/m) in vector form at the microstrip to waveguide transition operating near 10 GHz for a rear feed embodiment.

FIG. 5 depicts a field plot showing the electric field (in V/m) in vector form at the microstrip to waveguide transition operating near 10 GHz for the rear feed embodiment. The current travels down to microstrip feed line 212, then electrically couples to the proximity coupled patch antenna formed by the conductive antenna element 208. The current then couples to the waveguide 204. The current associated with the electric field vector alternates in a standing wave pattern.

Figure 6:
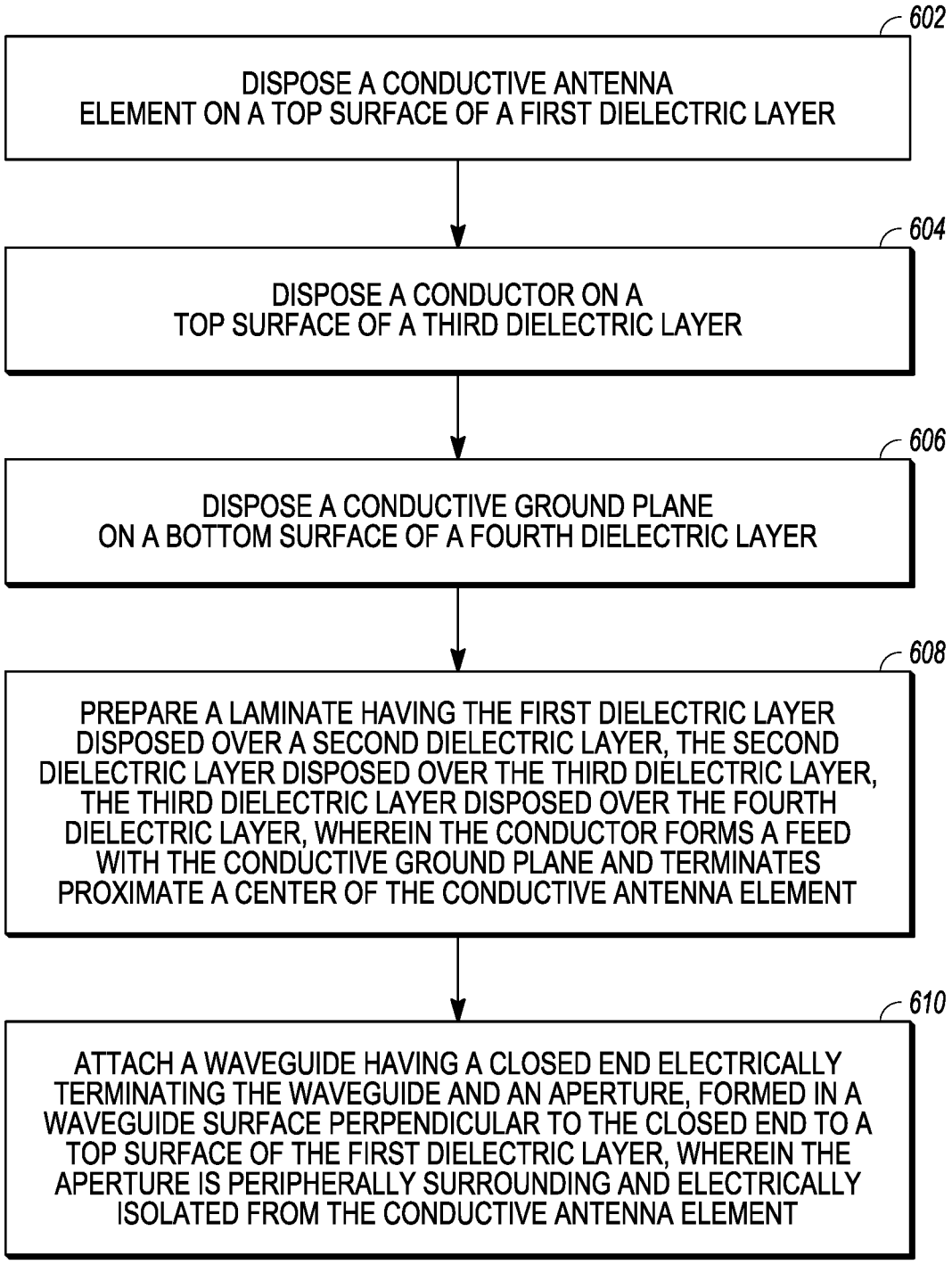
FIG. 6 is a diagram illustrating exemplary method steps for producing an RF circuit board having a feed to waveguide transition.
Figure 7:
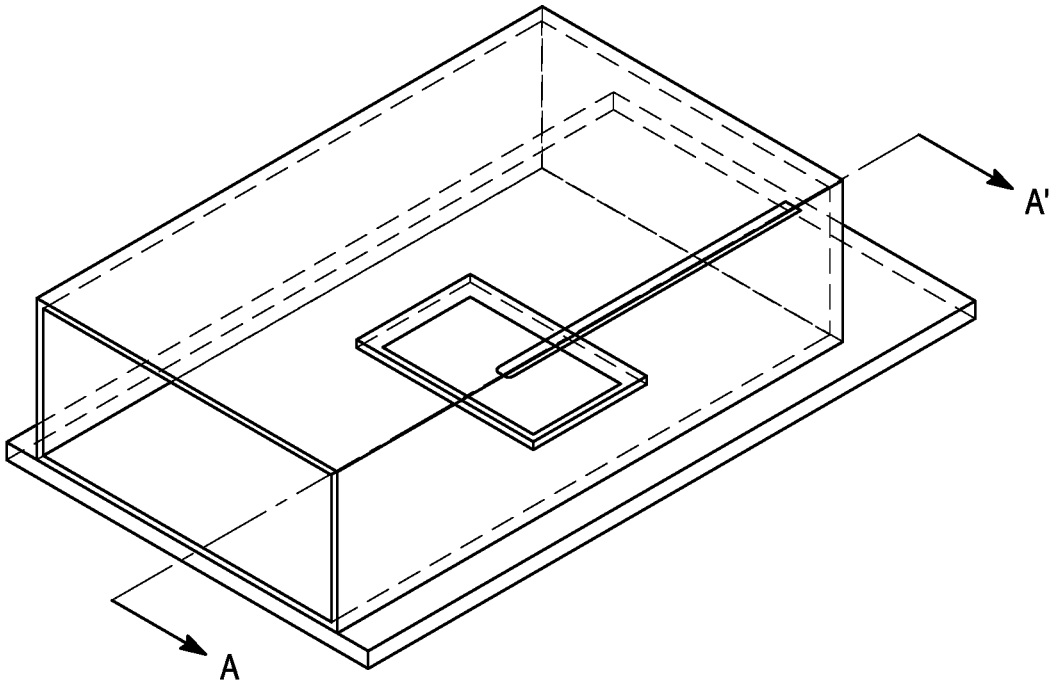
FIG. 7 is a diagram depicting the location of a cross section (A-A') of the RF circuit board.

FIG. 6 is a diagram illustrating exemplary method steps for producing an RF circuit board having a feed to waveguide transition. FIG. 6 is discussed in conjunction with FIG. 7, which is a diagram depicting the location of a cross section (A-A') of the RF circuit board, and FIGS. 8A-8F are diagrams illustrating the RF Circuit board in the stages of production. Each dielectric layer of the waveguide to microstrip feed transition can be produced using a combination of subtractive (e.g., laser etch, milling or wet etching) and additive (e.g., printing or film deposition) methods. The resulting layers are then aligned and bonded (e.g., lamination with adhesive films) to produce a subassembly. Vias connecting the conductor feed 212 (if necessary) are then etched and filled, following by attaching the waveguide 204 to the top of the laminate 202 to produce the final assembly.

Figures 8A, 8B, 8C, 8D, 8E, 8F:
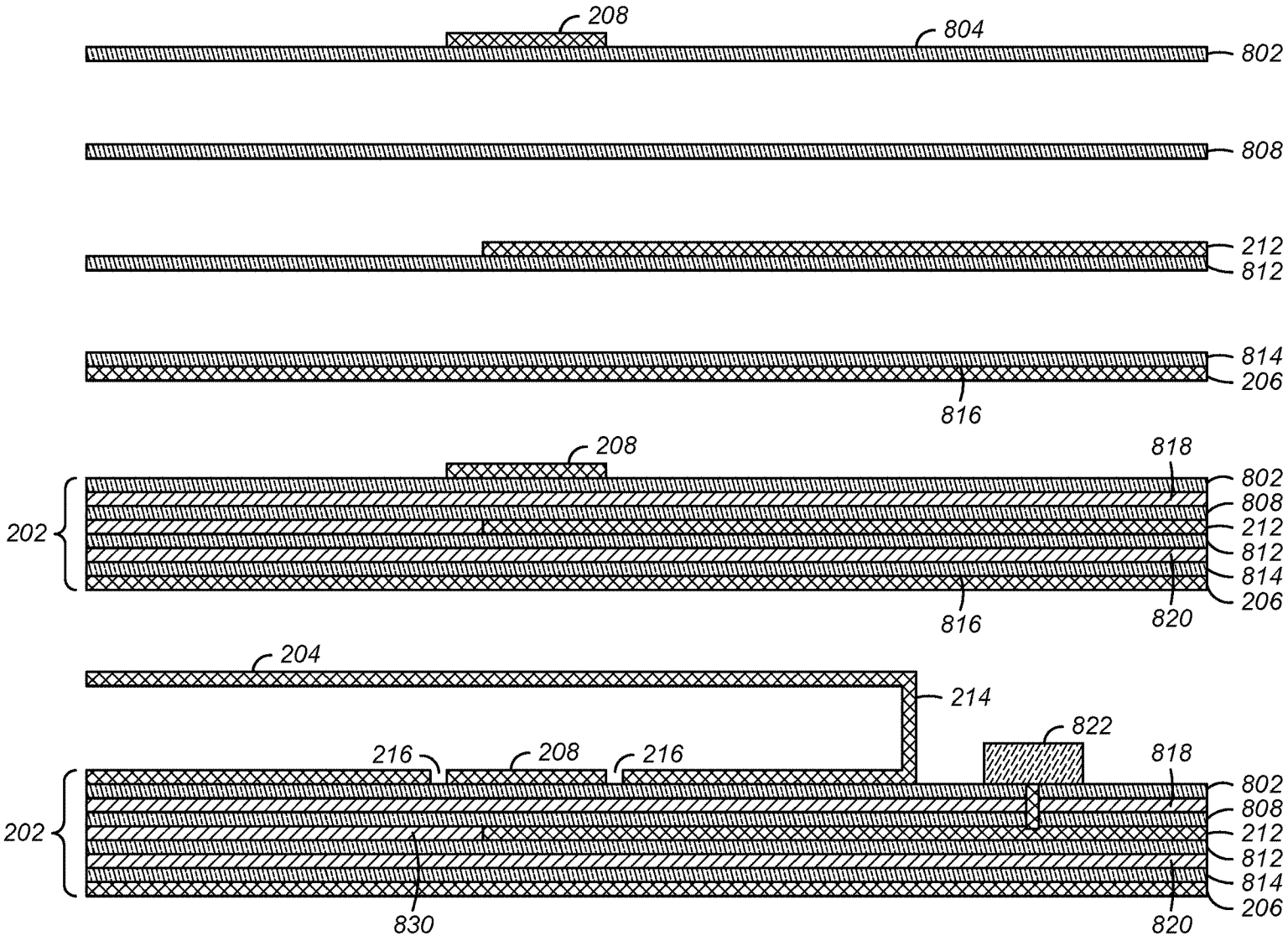
FIGS. 8A-8F are diagrams illustrating the RF circuit board in the stages of production.

Turning to FIG. 6, a conductive antenna element 208 is disposed on a top surface 804 of a first dielectric layer 802, as shown in block 602 and FIG. 8A. In block 604, a conductor 212 is disposed on a top surface of a third dielectric layer 812 as shown in FIG. 8C. In block 606, a conductive ground plane 206 is disposed on a bottom surface 816 of a fourth dielectric layer 814, as shown in FIG. 8D. In block 608, a laminate 202 is prepared by aligning the first dielectric layer 802, a second dielectric layer 808, the third dielectric layer 812, and the fourth dielectric layer 814, and laminating the first dielectric layer 802, the second dielectric layer 808 (FIG. 8B), the third dielectric layer 812, and the fourth dielectric layer 814 together. The layers are aligned with the conductor 212 terminating under the center of the conductive antenna element 208 and over the bottom surface conductive ground plane 206 thus forming a proximity coupled microstrip feed to the conductive antenna element 208. An exemplary alignment is illustrated in FIG. 8E. The layers 802, 808, 812 and 814 may be laminated by use of adhesive films 818, 820, and 830 disposed between such layers. The laminate 202 has the first dielectric layer 802 disposed over a second dielectric layer 808, the second dielectric layer 808 disposed over the third dielectric layer 812, and the third dielectric layer 812 disposed over the fourth dielectric layer 814, wherein the conductor 212 forms a feed with the bottom surface conductive ground plane 206 and terminates proximate a center of the conductive antenna element 208. In this embodiment, the conductor forms a microstrip feed.

As shown in block 610, and FIG. 8F a waveguide 204 having a closed end 214 electrically terminating the waveguide 204 and an aperture 210 of larger than the conductive antenna element 208 by a gap 216 is then attached to a top surface of the laminate 202, with the aperture 210 centered over the conductive antenna element 208. The aperture 210 is formed in the waveguide 204 surface perpendicular the waveguide closed end 214 and peripherally surrounds and is electrically isolated from the conductive antenna element 208. Finally, one or more electronic circuit components 822 can be affixed to the laminate 202, and electrically connected to the conductor 212 and one or more other electronic components. Such electrical components together comprise an electronic circuit, for example, for receiving or transmitting signals.

Stripline Feed Embodiments

Figure 9A:
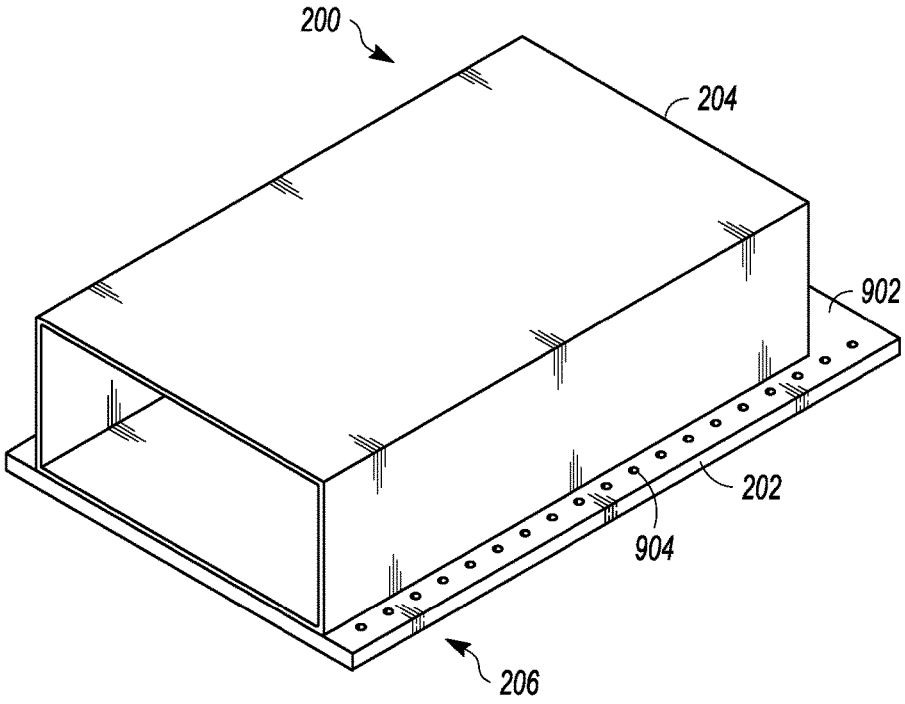
FIGS. 9A and 9B are diagrams depicting another embodiment of the RF circuit board.
Figure 9B:
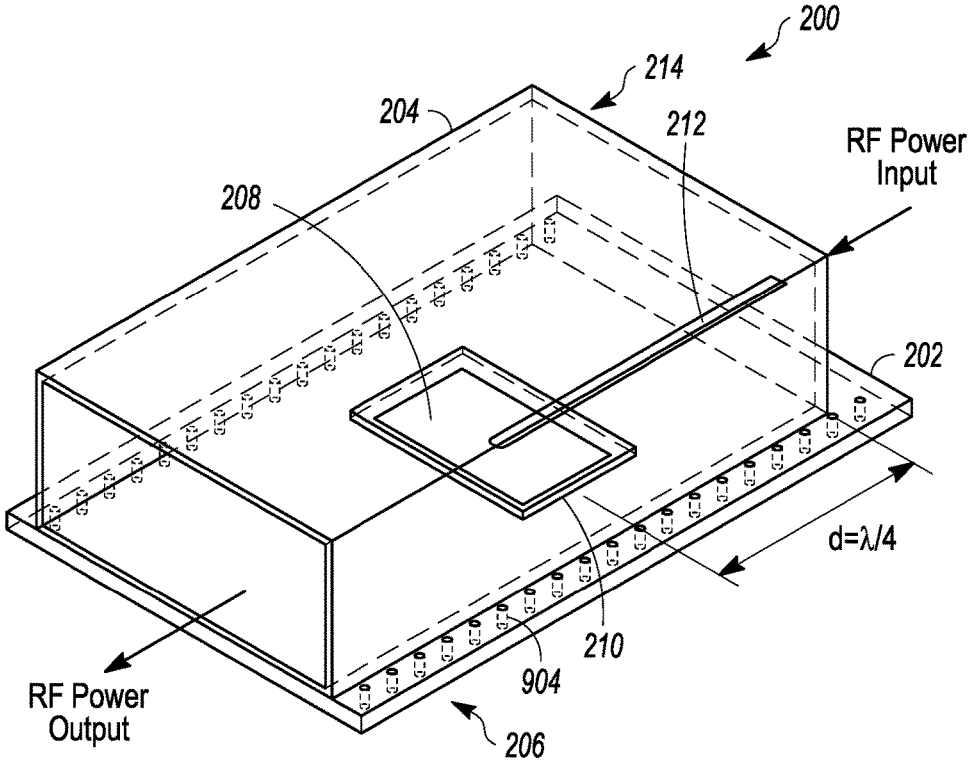

FIGS. 9A and 9B are diagrams depicting another embodiment of the RF circuit board 200. In the foregoing embodiments, the conductor 212 formed a microstrip feed with the bottom surface conductive ground plane 206 and the fourth dielectric layer 814. In the embodiment illustrated in FIGS. 9A and 9B the feed is a stripline feed, formed by the conductor 212 disposed between a top surface conductive ground plane 902 and the bottom surface conductive ground plane 206, with the top surface conductive ground plane 902 electrically short circuited to the bottom surface conductive ground plane 206 by a plurality of vias 904 extending through the laminate. In the illustrated embodiment, the vias 904 are disposed in a region of the laminate substantially adjacent to, but not under the waveguide, and are disposed in rows of vias 904 parallel to the waveguide longitudinal axis.

Figure 10A:
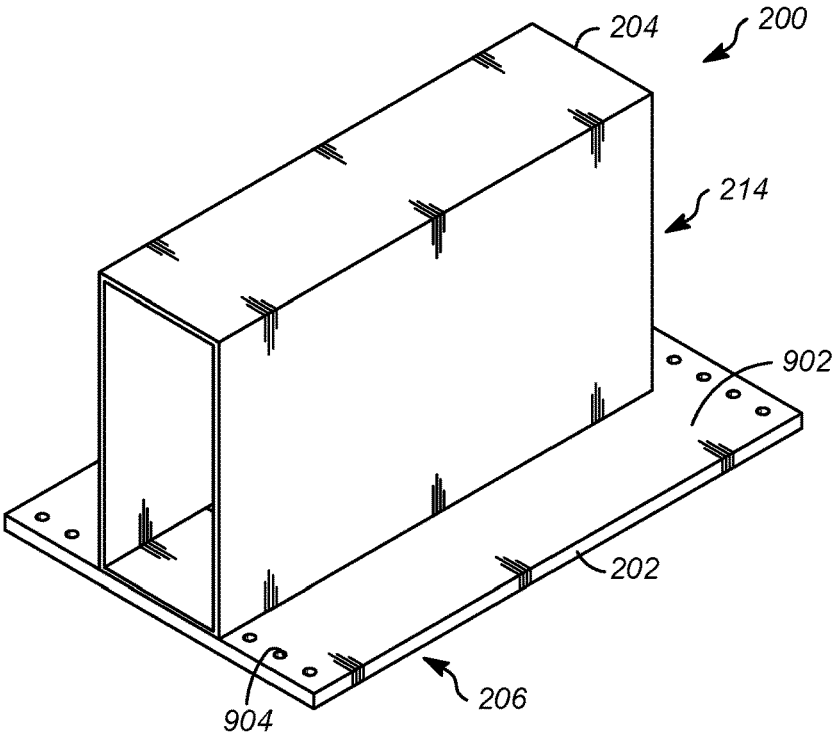
FIGS. 10A and 10B are diagrams depicting another embodiment of the stripline-fed RF circuit board.
Figure 10B:
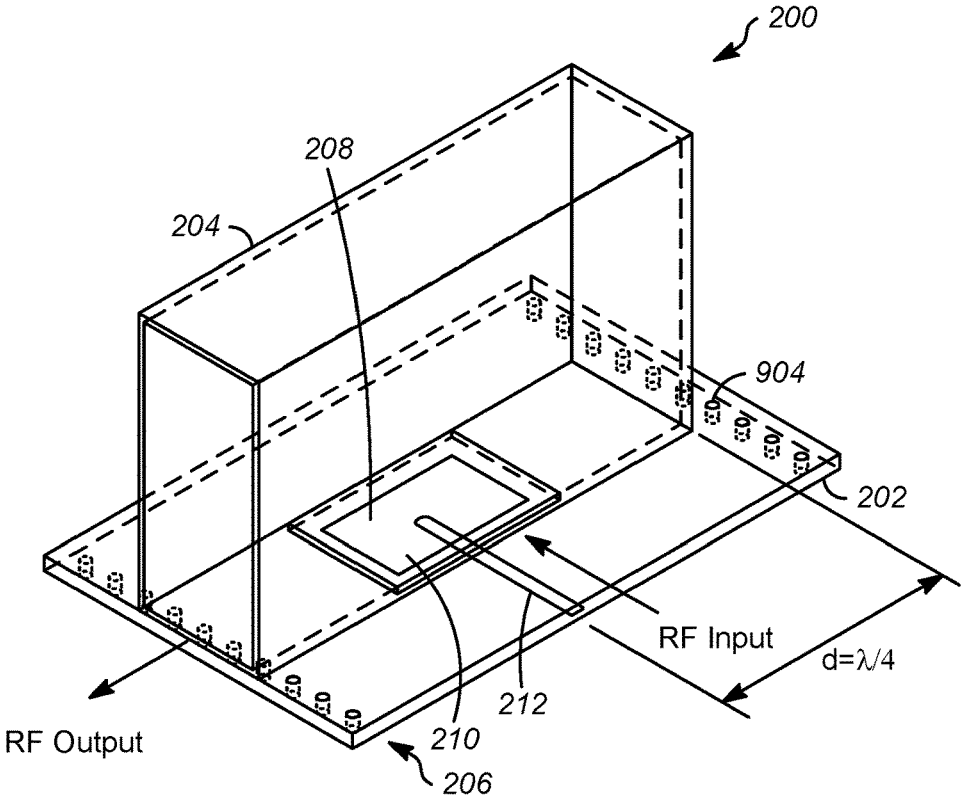

FIGS. 10A and 10B are diagrams depicting another embodiment of the stripline fed RF circuit board 200. This embodiment is similar to that of FIGS. 3A and 3B, but includes the vias 904 electrically short circuiting a top surface conductive ground plane 902 to the bottom surface conductive ground plane 206. This embodiment also illustrates the vias being disposed in a different location in the laminate 202. In this case, the vias 904 are disposed in rows perpendicular to the waveguide longitudinal axis, and some of the vias extend under the waveguide 204.

Figure 11:
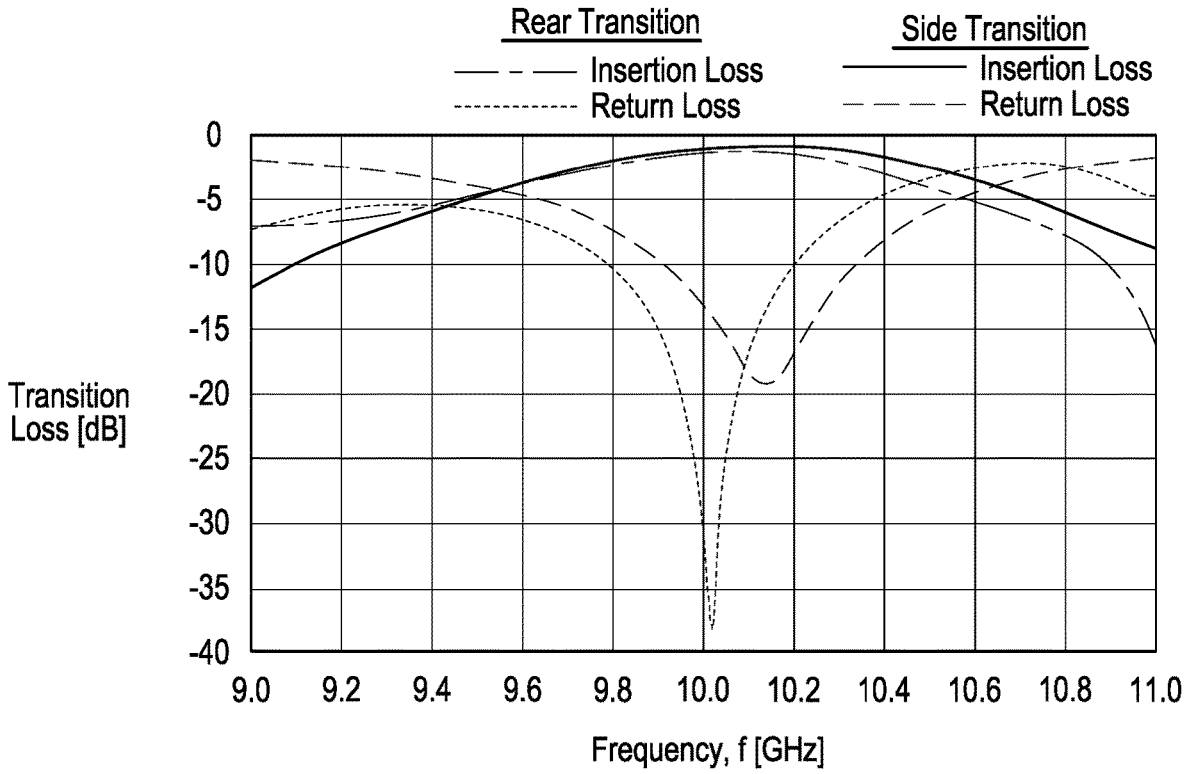
FIG. 11 is a diagram depicting the results of a numerical model simulation predicting the performance of the stripline to waveguide lateral transitions depicted in FIGS. 9A-9B, and 10A-10B designed to operate near 10 GHz.

FIG. 11 is a diagram depicting the results of a numerical model simulation predicting the performance of the stripline to waveguide lateral transitions depicted in FIGS. 9A-9B and 10A-10B designed to operate near 10 GHz. The results show the transition loss in dB (including both insertion and return loss) vs. frequency in GHz for the rear transition embodiment illustrated in FIGS. 9A and 9B and a side transition embodiment illustrated in FIGS. 10A and 10B. These results were developed using a finite element method (FEM) solver.

The rear feed embodiment illustrated in FIGS. 9A and 9B has a conductor 212 forming a stripline feed electrically coupled to the waveguide 204 from the closed end of the waveguide 214. The model predicts an insertion loss of ~1.2 dB, a 3 dB bandwidth of ~940 MHz, and a 2:1 VSWR impedance bandwidth of ~430 MHz The side feed embodiment illustrated in FIGS. 10A and 10B has a conductor 212 forming a microstrip electrically coupled to a waveguide 204 from the side of the waveguide 204. The model predicts performance comparable to that of the microstrip embodiment of FIGS. 3A and 3B with an insertion loss of ~0.9 dB, a 3 dB bandwidth of ~1030 MHz, and a 2:1 VSWR impedance bandwidth of ~460 MHz.

Figure 12:
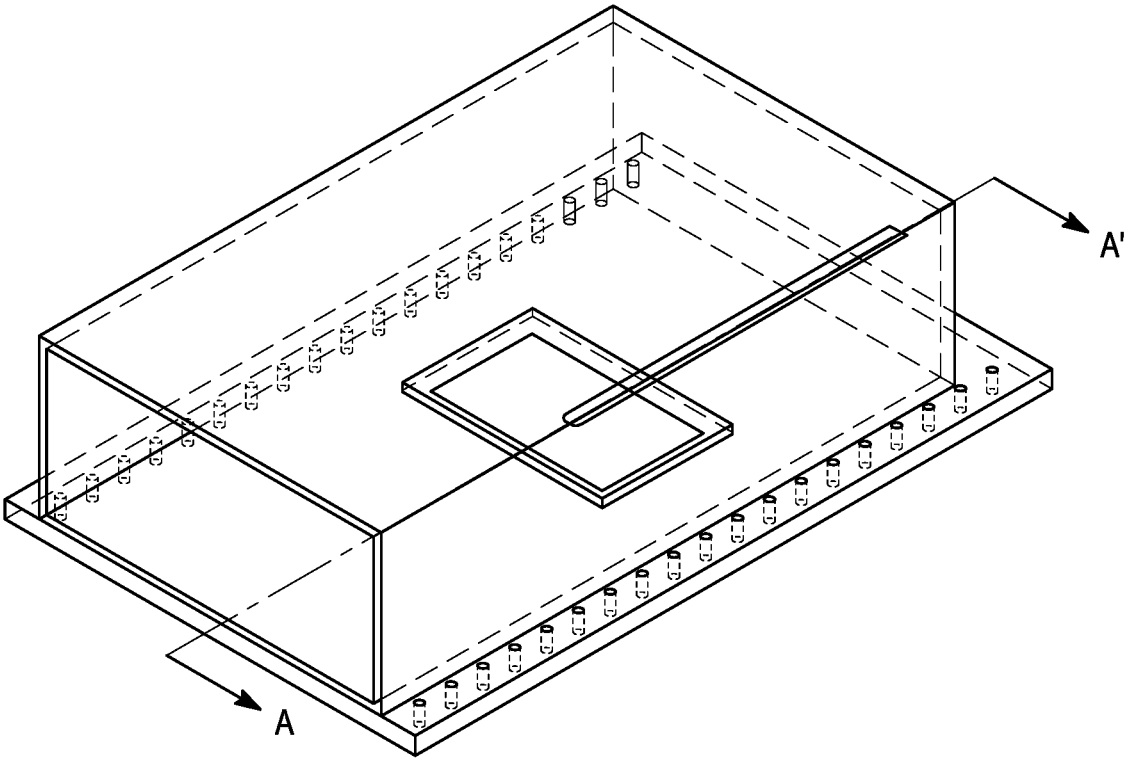
FIG. 12 depicts a field plot showing the electric field (in V/m) in vector form at the stripline to waveguide transition operating near 10 GHz for the rear feed embodiment.
Figures 13A, 13B, 13C, 13D, 13E, 13F:
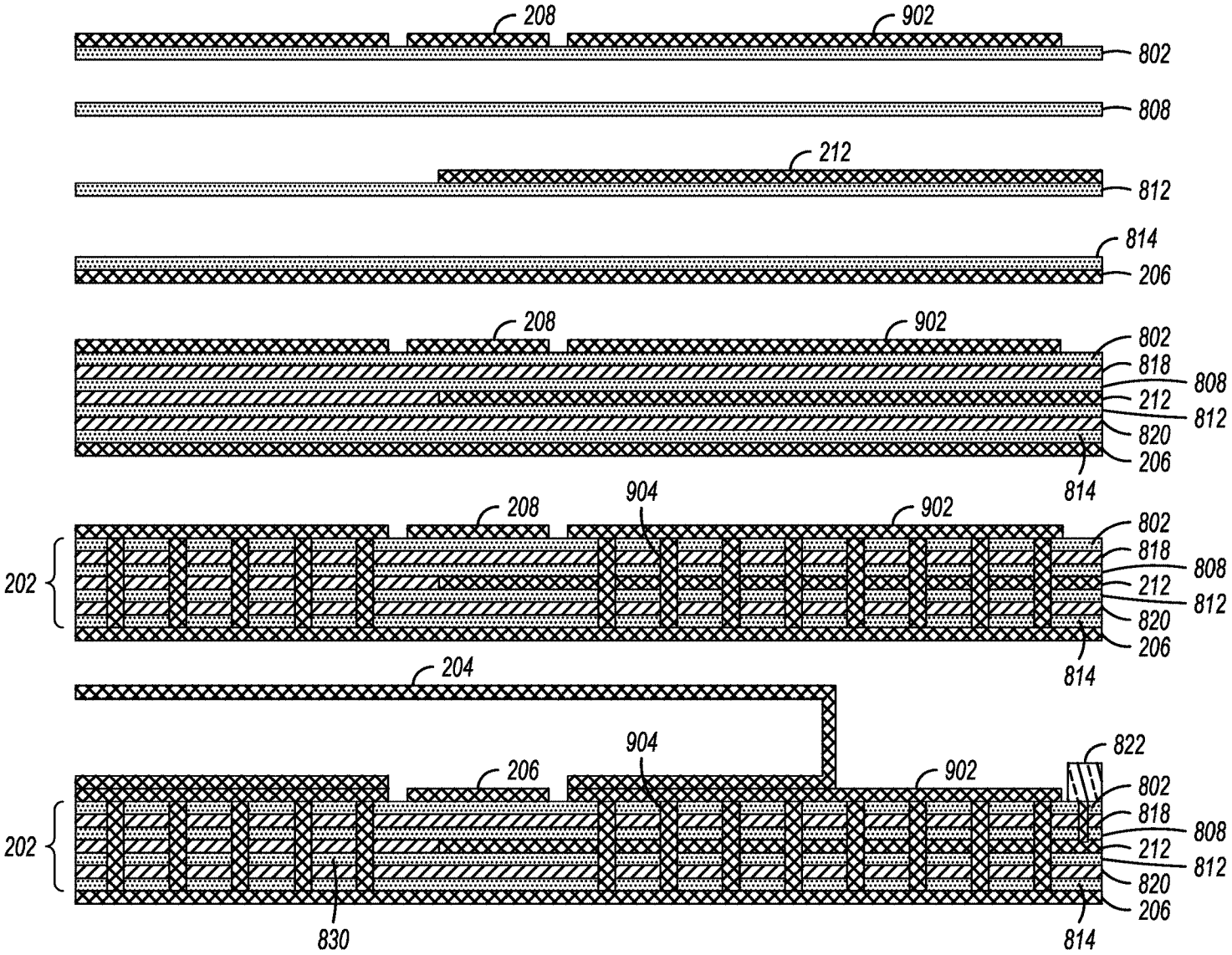
FIGS. 13A-13F are diagrams illustrating the stripline to RF circuit board in the stages of assembly/production.

FIG. 12 is a diagram depicting the location of a cross section (A-A') of the RF circuit board having the stripline to waveguide transition, and FIGS. 13A-13F, which are diagrams illustrating the RF circuit board 200 in the stages of assembly/production. The production steps are the same as those illustrated in FIG. 6. However, to produce this embodiment, the step illustrated in block 602 (disposing a conductive antenna element 208 on a top surface of the first dielectric layer 802) is modified to include disposing a top surface conductive ground plane 902 peripherally surrounding the conductive antenna element 208 on the top surface of the first dielectric layer 802 as well, as depicted in FIG. 13D. Further, after preparing the laminate 202 as depicted in FIG. 13F, a plurality of vias 904 are formed through the laminate 202 as depicted in FIG. 13F. The vias 904 are then filled with a conductive material to electrically short circuit the top surface conductive ground plane 902 to the bottom surface conductive ground plane 206. As was the case in the embodiment illustrated in FIGS. 8A-8F, one or more electronic circuit components 822 can be affixed to the laminate 202, and electrically connected to the conductor 212 and one or more other electronic components. Such electrical components together comprise an electronic circuit, for example, for receiving or transmitting signals.

To the extent that terms "includes," "including," "has," "contains," and variants thereof are used herein, such terms are intended to be inclusive in a manner similar to the term "comprises" as an open transition word without precluding any additional or other elements. The term ""exemplary" is used herein to mean serving as an example, instance, or illustration and is not necessarily to be construed as preferred or advantageous.

The foregoing discloses a feed to waveguide lateral transition. One embodiment is evidenced by a circuit board, including: a laminate, the laminate including: a conductive antenna element disposed on a top surface of a first dielectric layer; a second dielectric layer having a top surface disposed below and adjacent a bottom surface of the first dielectric layer; a conductor, disposed on a top surface of a third dielectric layer, the third dielectric layer having a top surface disposed below and adjacent to a bottom surface of the second dielectric layer; and a bottom surface conductive ground plane disposed on a bottom surface of a fourth dielectric layer, the fourth dielectric layer having a top surface disposed below and adjacent to a bottom surface of the third dielectric layer; a waveguide, including: a closed end electrically terminating the waveguide; an aperture, formed in a waveguide surface perpendicular to the closed end; and where the waveguide is attached to the top surface of the first dielectric layer with the aperture peripherally surrounding and electrically isolated from the conductive antenna element.

Implementations may include one or more of the following features:

The circuit board of the above clause, where the aperture is formed a quarter wavelength from the closed end of the waveguide along a longitudinal axis of the waveguide.

The circuit board of any combination of the above clauses where the waveguide is configured to propagate electromagnetic energy along a waveguide longitudinal axis; and the conductor is along a conductor longitudinal axis parallel to the waveguide longitudinal axis.

The circuit board of any combination of the above clauses where the waveguide propagates electromagnetic energy along a waveguide longitudinal axis; and the conductor is disposed along a conductor longitudinal axis perpendicular to the waveguide longitudinal axis.

The circuit board of any combination of the above clauses where the conductive antenna element includes a patch antenna element proximity coupled to a feed formed by the conductor.

The circuit board of any combination of the above clauses where the waveguide includes a rectangular cross section having an interior height and an interior width; the interior height is greater than the interior width; and the aperture is coextensive with the interior width of the waveguide.

The circuit board where the conductor and the bottom surface conductive ground plane together include a microstrip feed to the conductive antenna element.

The circuit board of any combination of the above clauses where the laminate further includes: a top surface conductive ground plane disposed on a top surface of the first dielectric layer; a plurality of vias extending through the laminate, electrically short circuiting the top surface conductive ground plane and the bottom surface conductive ground plane; and where the conductor, the bottom surface conductive ground plane, and the top surface conductive ground plane include a stripline feed to the conductive antenna element. The circuit board further including: a radio frequency (RF) electronic circuit, electrically connected to the conductor.

A further embodiment is evidenced by a method, including: disposing a conductive antenna element on a top surface of a first dielectric layer; disposing a conductor on a top surface of a third dielectric layer; disposing a conductive ground plane on a bottom surface of a fourth dielectric layer; preparing a laminate having the first dielectric layer disposed over a second dielectric layer, the second dielectric layer disposed over the third dielectric layer, and the third dielectric disposed over the fourth dielectric layer, where the conductor forms a feed with the conductive ground plane and terminates proximate a center of the conductive antenna element; and where the laminate is to be attached to a waveguide having a closed end electrically terminating the waveguide and an aperture, formed in a waveguide surface perpendicular to the closed end, to a top surface of the first dielectric layer, and of where the waveguide has a closed end electrically terminating the waveguide; and the aperture is formed in a waveguide surface perpendicular to the closed end, the aperture peripherally surrounding and electrically isolated from the conductive antenna element.

Implementations include one or more of the following features:

The method of the above clause where the aperture is formed a quarter wavelength from the closed end of the waveguide along a longitudinal axis of the waveguide.

The method of any combination of the above clauses where the waveguide propagates electromagnetic energy along a waveguide longitudinal axis; and the conductor is along a conductor longitudinal axis parallel to the waveguide longitudinal axis.

The method of any combination of the above clauses where the waveguide propagates electromagnetic energy along a waveguide longitudinal axis; and the conductor is along a conductor longitudinal axis perpendicular to the waveguide longitudinal axis.

The method of any combination of the above clauses where the conductive antenna element includes a patch antenna element proximity coupled to a feed formed at least in part by the conductor.

The method of any combination of the above clauses where the waveguide includes a rectangular cross section having an interior height and an interior width; the interior height is greater than the interior width; and the aperture is coextensive with the interior width of the waveguide.

The method of any combination of the above clauses where the conductor and the bottom surface conductive ground plane together include a microstrip feed to the conductive antenna element.

The method of any combination of the above clauses where disposing the conductive antenna element on a top surface of a first dielectric layer includes: disposing the conductive antenna element and a top surface conductive ground plane peripherally surrounding the conductive antenna element on the top surface of the first dielectric layer; the method further includes: after preparing the laminate, forming a plurality of vias through the laminate; and filling the vias with a conductive material to electrically short circuit the top surface conductive ground plane and the bottom surface conductive ground plane.

The method of any combination of the above clauses also include where the conductor and the bottom surface conductive ground plane together include a stripline feed to the conductive antenna element. The method further including: disposing a radio frequency (RF) electronic circuit on the laminate, the RF electronic circuit electrically connected to the conductor.

Another embodiment is evidenced by a circuit board, produced by performing steps including the steps of: disposing a conductive antenna element on a top surface of a first dielectric layer; disposing a conductor on a top surface of a third dielectric layer; disposing a conductive ground plane on a bottom surface of a fourth dielectric layer; preparing a laminate having the first dielectric layer disposed over a second dielectric layer, the second dielectric layer disposed over the third dielectric layer, and the third dielectric layer disposed over the fourth dielectric layer, where the conductor forms a feed with the conductive ground plane and terminates proximate a center of the conductive antenna element; and where the laminate is to be attached to a waveguide having a closed end electrically terminating the waveguide and an aperture, formed in a waveguide surface perpendicular to the closed end, to a top surface of the first dielectric layer, where the waveguide has a closed end electrically terminating the waveguide; and the aperture is formed in a waveguide surface perpendicular to the closed end, the aperture peripherally surrounding and electrically isolated from the conductive antenna element.

Implementations further include one or more of the following features:

The circuit board described above where disposing the conductive antenna element on a top surface of a first dielectric layer includes: disposing the conductive antenna element and a top surface conductive ground plane peripherally surrounding the conductive antenna element on the top surface of the first dielectric layer; the steps further include: after preparing the laminate, forming a plurality of vias through the laminate; and filling the vias with a conductive material to electrically short the top surface conductive ground plane and the bottom surface conductive ground plane.

The circuit board of any combination of the above clauses where the conductor and the bottom surface conductive ground plane together include a stripline feed to the conductive antenna element.

Those skilled in the art will recognize many modifications may be made to this configuration without departing from the scope of the present disclosure. For example, those skilled in the art will recognize that any combination of the above components, or any number of different components, peripherals, and other devices, may be used.

Conclusion

This concludes the description of the preferred embodiments of the present disclosure. The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. A circuit board, comprising:

a laminate, the laminate comprising:

a conductive antenna element disposed on a top surface of a first dielectric layer;

a second dielectric layer having a top surface disposed below and adjacent a bottom surface of the first dielectric layer;

a conductor, disposed on a top surface of a third dielectric layer, the top surface of the third dielectric layer disposed below and adjacent to a bottom surface of the second dielectric layer; and a bottom surface conductive ground plane disposed on a bottom surface of a fourth dielectric layer, the fourth dielectric layer having a top surface disposed below and adjacent to a bottom surface of the third dielectric layer;

a waveguide, comprising:

a closed end electrically terminating the waveguide;

an aperture, formed in a side of the waveguide on a waveguide surface perpendicular to the closed end; and wherein:

the waveguide surface is attached to the top surface of the first dielectric layer with the aperture peripherally surrounding and electrically isolated from the conductive antenna element;

the aperture is formed a quarter wavelength from the closed end of the waveguide along a longitudinal axis of the waveguide;

the waveguide is configured to propagate electromagnetic energy along the longitudinal axis of the waveguide; and the conductor is disposed along a conductor longitudinal axis perpendicular to the longitudinal axis of the waveguide.

2. The circuit board of claim 1, wherein the conductor and the bottom surface conductive ground plane together comprise a microstrip feed to the conductive antenna element.

3. The circuit board of claim 1, wherein:

the laminate further comprises:

a top surface conductive ground plane disposed on the top surface of the first dielectric layer;

a plurality of vias extending through the laminate, electrically short circuiting the top surface conductive ground plane and the bottom surface conductive ground plane; and wherein the conductor, the bottom surface conductive ground plane, and the top surface conductive ground plane comprise a stripline feed to the conductive antenna element.

4. The circuit board of claim 1, further comprising:

a radio frequency (RF) electronic circuit, electrically connected to the conductor.

5. The circuit board of claim 1, wherein the conductive antenna element comprises a patch antenna element proximity coupled to a feed formed by the conductor.

6. The circuit board of claim 5, wherein:

the waveguide comprises a rectangular cross section having an interior height and an interior width;

the interior height is greater than the interior width; and the aperture is coextensive with the interior width of the waveguide.

7. A circuit board, comprising:

a laminate, the laminate comprising:

a conductive antenna element disposed on a top surface of a first dielectric layer;

a second dielectric layer having a top surface disposed below and adjacent a bottom surface of the first dielectric layer;

a conductor, disposed on a top surface of a third dielectric layer, the top surface of the third dielectric layer disposed below and adjacent to a bottom surface of the second dielectric layer; and a bottom surface conductive ground plane disposed on a bottom surface of a fourth dielectric layer, the fourth dielectric layer having a top surface disposed below and adjacent to a bottom surface of the third dielectric layer;

a waveguide, comprising:

a closed end electrically terminating the waveguide;

an aperture, formed in a side of the waveguide on a waveguide surface perpendicular to the closed end; and wherein:

the waveguide surface is attached to the top surface of the first dielectric layer with the aperture peripherally surrounding and electrically isolated from the conductive antenna element;

the conductive antenna element comprises a patch antenna element proximity coupled to a feed formed by the conductor;

the waveguide comprises a rectangular cross section having an interior height and an interior width;

the interior height is greater than the interior width; and the aperture is coextensive with the interior width of the waveguide.

8. The circuit board of claim 7, wherein the conductor and the bottom surface conductive ground plane together comprise a microstrip feed to the conductive antenna element.

9. A circuit board, produced by performing steps comprising:

disposing a conductive antenna element on a top surface of a first dielectric layer;

disposing a conductor on a top surface of a third dielectric layer;

disposing a conductive ground plane on a bottom surface of a fourth dielectric layer;

preparing a laminate having the first dielectric layer disposed over a second dielectric layer, the second dielectric layer disposed over the third dielectric layer, and the third dielectric layer disposed over the fourth dielectric layer, wherein the conductor forms a feed with the conductive ground plane and terminates proximate a center of the conductive antenna element; and wherein:

the top surface of the first dielectric layer is to be attached to a side surface of a waveguide, the waveguide having:

a closed end electrically terminating the waveguide;

an aperture, formed in the side surface of the waveguide, the side surface of the waveguide disposed perpendicular to the closed end, the aperture peripherally surrounding and electrically isolated from the conductive antenna element;

the aperture is formed a quarter wavelength from the closed end of the waveguide along a longitudinal axis of the waveguide;

the waveguide propagates electromagnetic energy along the longitudinal axis of the waveguide; and the conductor is along a conductor longitudinal axis perpendicular to the longitudinal axis of the waveguide.

10. The circuit board of claim 9, wherein:

disposing the conductive antenna element on the top surface of the first dielectric layer comprises:

disposing the conductive antenna element and a top surface conductive ground plane peripherally surrounding the conductive antenna element on the top surface of the first dielectric layer to thereby form the aperture;

the steps further comprise:

after preparing the laminate, forming a plurality of vias through the laminate; and filling the vias with a conductive material thereby to electrically short circuit the top surface conductive ground plane to the conductive ground plane; and wherein the top surface ground plane, the conductor and the conductive ground plane together comprise a stripline feed to the conductive antenna element.

11. The circuit board of claim 9, wherein the conductive antenna element comprises a patch antenna element proximity coupled to the feed formed at least in part by the conductor.

12. The circuit board of claim 11, wherein:

the waveguide comprises a rectangular cross section having an interior height and an interior width;

the interior height is greater than the interior width; and the aperture is coextensive with the interior width of the waveguide.

13. The circuit board of claim 9, wherein the feed is a microstrip feed to the conductive antenna element.

14. The circuit board of claim 9, wherein the steps further comprise the step of:

disposing a radio frequency (RF) electronic circuit on the laminate, the RF electronic circuit electrically connected to the conductor.

15. A method, comprising:

disposing a conductive antenna element on a top surface of a first dielectric layer;

disposing a conductor on a top surface of a third dielectric layer;

disposing a conductive ground plane on a bottom surface of a fourth dielectric layer;

preparing a laminate having the first dielectric layer disposed over a second dielectric layer, the second dielectric layer disposed over the third dielectric layer, and the third dielectric layer disposed over the fourth dielectric layer, wherein the conductor forms a feed with the conductive ground plane and terminates proximate a center of the conductive antenna element; and wherein:

the top surface of the first dielectric layer is to be attached to a side surface of a waveguide, the waveguide having:

a closed end electrically terminating the waveguide;

an aperture, formed in the side surface of the waveguide perpendicular to the closed end, the aperture peripherally surrounding and electrically isolated from the conductive antenna element;

the aperture is formed a quarter wavelength from the closed end of the waveguide along a longitudinal axis of the waveguide;

the waveguide propagates electromagnetic energy along the longitudinal axis of the waveguide; and the conductor is along a conductor longitudinal axis perpendicular to the longitudinal axis of the waveguide.

16. The method of claim 15, wherein the feed is a microstrip feed to the conductive antenna element.

17. The method of claim 15, wherein:

disposing the conductive antenna element on the top surface of the first dielectric layer comprises:

disposing the conductive antenna element and a top surface conductive ground plane peripherally surrounding the conductive antenna element on the top surface of the first dielectric layer, thereby placing the aperture peripherally surrounding and electrically isolated from the conductive antenna element;

the method further comprises:

after preparing the laminate, forming a plurality of vias through the laminate; and filling the vias with a conductive material thereby electrically short circuiting the top surface conductive ground plane to the conductive ground plane; and wherein the top surface conductive ground plane, the conductor and the conductive ground plane together comprise a stripline feed to the conductive antenna element.

18. The method of claim 15, further comprising:

disposing a radio frequency (RF) electronic circuit on the laminate, the RF electronic circuit electrically connected to the conductor.

19. The method of claim 15, wherein the conductive antenna element comprises a patch antenna element proximity coupled to the feed formed at least in part by the conductor.

20. The method of claim 19, wherein:

the waveguide comprises a rectangular cross section having an interior height and an interior width;

the interior height is greater than the interior width; and the aperture is coextensive with the interior width of the waveguide.

* * * * *